United States Patent [19]

Wrucke

[11] 4,444,389

[45] Apr. 24, 1984

[54] TENDON STRETCHING DEVICE

[76] Inventor: Robert T. Wrucke, 30 Cima Way, Portola Valley, Calif. 94025

[21] Appl. No.: 314,200

[22] Filed: Oct. 23, 1981

[51] Int. Cl.[3] ..... A63B 23/04

[52] U.S. Cl. ..... 272/96

[58] Field of Search ..... 272/96, 105, 93; 128/75, 25 B; 36/11.5

[56] References Cited

U.S. PATENT DOCUMENTS 3,722,113 3/1973 Birkenstock ..... 36/11.5

4,200,997 5/1980 Scheinhaus et al. ..... 36/11.5

FOREIGN PATENT DOCUMENTS 749775 5/1956 United Kingdom ..... 36/11.5

*Primary Examiner*—Richard C. Pinkham

*Assistant Examiner*—Matthew L. Schneider

[57] ABSTRACT

A tendon stretching device comprising a long rigid base member which acts as a lever, and a restraining band assembly pivotally mounted near one end of the member which consists of a hasp and a buckle mounted to the sides of the base member and a flexible band that is threaded through the hasp and buckle, the length of which can be increased or decreased and which can be rotated such that the flexible band can be moved to either side of the base member, allowing the device to be used on either side.

5 Claims, 3 Drawing Figures

TENDON STRETCHING DEVICE

Generally the device of the present invention is used to increase the angle to which a foot can be pointed away from the knee by stretching the tendons in the foot. Dancers and gymnasts need to point their feet to produce a desired appearance in performances and competitions. Gracefully extended feet are important aspects of appearance. In the past, stretching tendons in the feet has been accomplished by having another person apply pressure by hand. This tendon stretching device allows a person to stretch the tendons in his (her) feet without the aid of another person.

The invention provides a rigid base member which acts as a lever. Attached near one end of the base member is an adjustable restraining band assembly.

In general the objective of the invention is to provide a device that allows a person to stretch the tendons in one's feet in a personal and independent manner.

Another objective of the invention is to provide a device that duplicates the effectiveness of having another person stretch the tendons in one's feet by hand.

This invention relates generally to stretching the tendons in the foot by creating a means to increase as far as possible the angle in which the foot can be outwardly extended.

Additional objectives and features of the invention will be apparent from the following description in which the preferred embodiment is set forth in detail in conjunction with the accompanying drawings.

Figure 1:
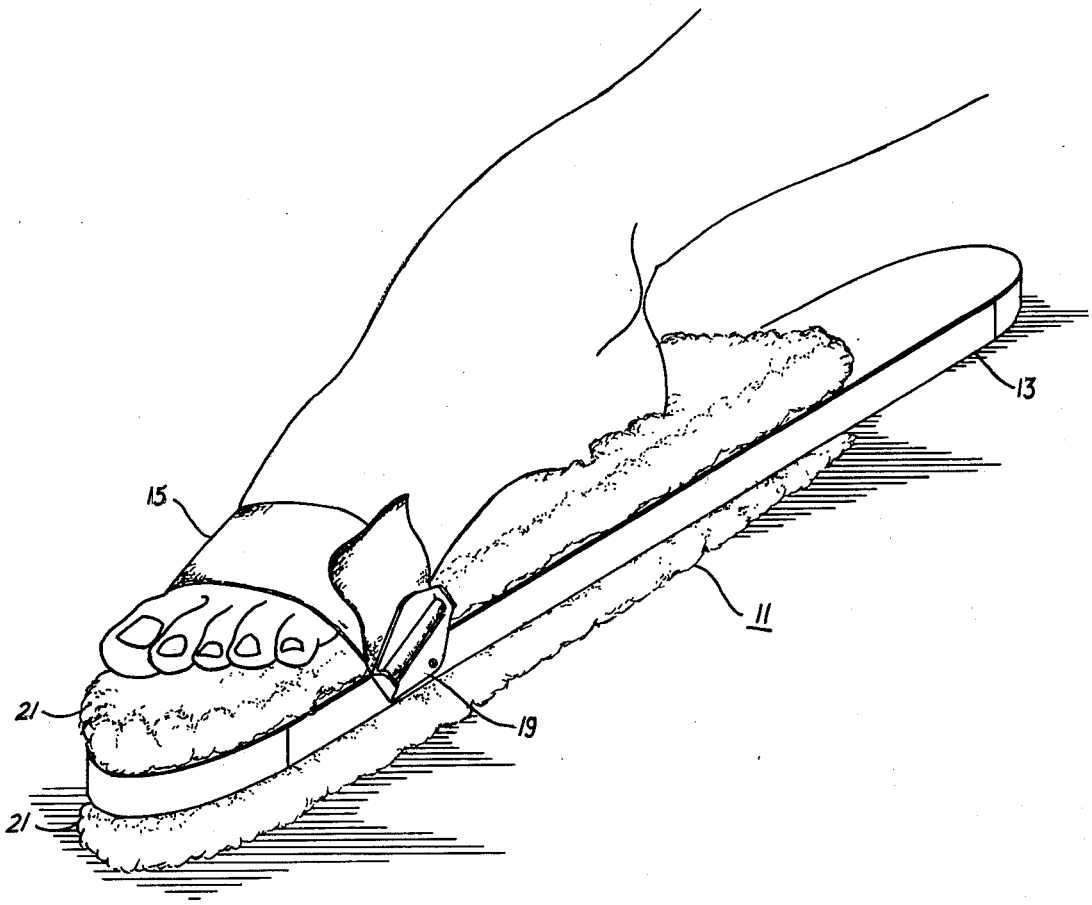
FIG. 1 is an isometric of a foot stretching device in accordance with the invention with a foot properly inserted.

As illustrated, the device for stretching tendons in the foot 11 is comprised of a long rigid base member 13 and a restraining assembly includes a cloth band 15 that is threaded through a hasp 17 with a buckle 19.

The long rigid base member 13 is made of wood or other suitable material measuring approximately ¾" thick, 3" wide, and 20" long. The length is great enough to provide effective leverage when the device is used and is short enough so the device is convenient to carry.

The top and bottom sides of the base member are partially covered with a cushioning foam which, in turn, is covered by a fur fabric 21 or by other suitable cushioning materials. The foam and fabric cushioning 21 cover the width of the board member and extends from that end of the base member near the attachment of the restraining assembly, to a point along the base member 13 sufficient to cushion the heel of a human foot when the device is used.

Both the hasp 17 and the buckle 19 are made of stainless steel or other suitable material. Each is pivotally mounted on opposite sides of the base member.

The buckle 19 has two parallel elongated slots 23 and 25 through which the restraining band 15 is threaded. A portion of the buckle above the top slot is bent in toward the long rigid base member to form an elongate tab 27. This tab 27 acts to prevent the restraining band 15 from slipping when the device 11 is used. On the top of the buckle 19 is a second tab 29 that is bent outward from the base member 13. This tab 29 is used as an aid in adjusting the restraining band 15. Pushing the tab 29 and buckle 19 away from the base member 13 releases the restraining band 15.

Figure 2:
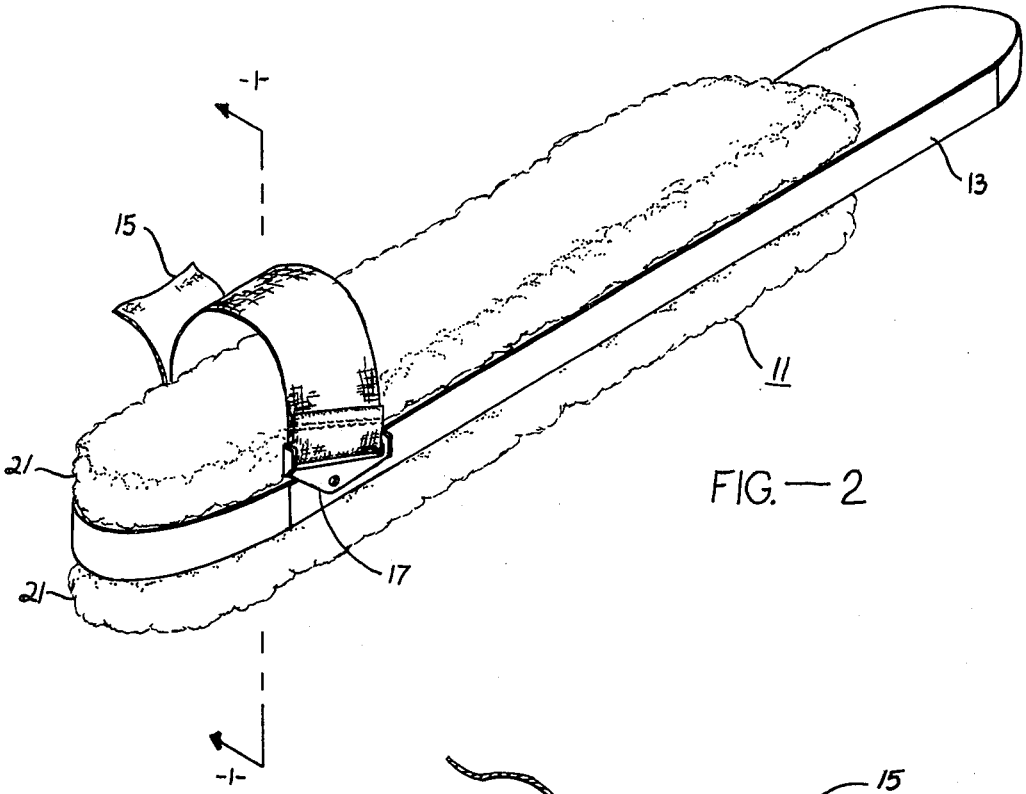
FIG. 2 is an isometric view of a foot stretching device of FIG. 1.
Figure 3:
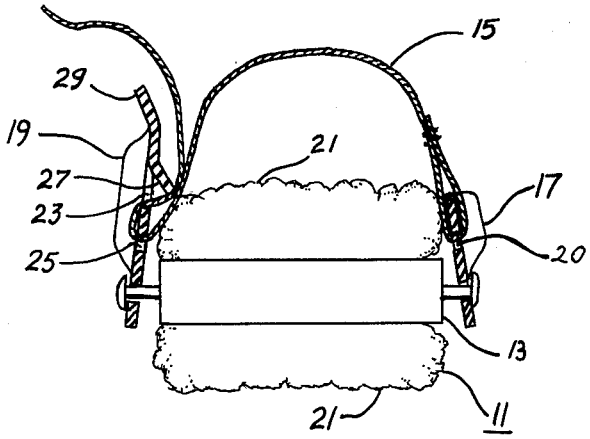
FIG. 3 is a side elevation section view taken along line 1—1 of FIG. 2.

As can be seen in FIGS. 1 and 2, a restraining band 15 made of heavy woven strapping material is threaded through the slots on the hasp 17 and buckle 19. One end of the restraining band 15 is suitably secured to the hasp 17 such as by threading it through the slot 20 in the hasp 17, then affixing the end of the strap to an unthreaded portion of the strapping. The other end of the restraining band 15 is threaded through the two slots 23 and 25 of the buckle 19 in such a manner that the length of the strap between the hasp and buckle can be adjusted. As seen in FIG. 3, the strap 15 is first threaded through the bottom slot 25, going from the inward side outward. The band 15 is then threaded through the upper slot 23 by passing it from the outside to the inner-facing side of the buckle 19.

Operation of the device is as follows. First a person sits on the floor or other flat surface. As illustrated in FIG. 1, the person places a foot on the long rigid base member and under the restraining band. The foot is positioned under the restraining band in such a manner that the band is just behind all the toes. The base member is placed parallel to the leg with the rear of the base member under the calf of the leg. When positioning the device, the leg should be bent from the knee up. To stretch the tendons of the foot, the user straightens the leg by pressing the knee downward and sliding the foot forward, keeping the device on the floor. The knee is pressed downward until the desired tension is achieved in the upper tendons of the foot.

The restraining band can be adjusted by increasing or decreasing its length between the hasp and buckle. The adjustment is performed by pushing outward on the upper tab of the buckle, and at the same time pulling on the restraining band with the other hand.

As illustrated in FIGS. 1 and 2, the hasp is located closer to the forward end of the base member than the buckle. This arrangement provides maximum comfort to the feet. Both the buckle and hasp pivot to properly position the band when in use and to allow the band to be rotated to the opposite side of the base member. This allows one to use either side of the base member. The sides correspond to either a left or a right foot. The angle of the restraining band in relation to the base member determines which side of the base member is for the left or right foot.

Having thus made a full disclosure of preferred embodiments of the tendon stretching device constituting this invention, reference is directed to the appended claims for the scope of protection to be afforded thereto.

What is claimed is:

1. A device for stretching tendons in the foot to increase the angle to which a foot can be pointed in an outwardly direction away from the knee comprising a long rigid base member having an upper and lower face and a restraining assembly connected near one end of the base member, said restraining assembly adapted to cross over the top of the foot and is pivotally attached to said base member whereby the device may be used from either side of the long rigid base member with the restraining assembly positioned optimally over the top of the foot, said long rigid base member being approximately twice the length of the user's foot.

2. A device as defined in claim 1, together with cushioning means disposed along at least one face of said base member.

3. A device as defined in claim 2, together with cushioning means disposed along both faces of said base member, said cushioning means being positioned from that end of the base member to which the restraining assembly is attached to a point at least midway between the ends of the long rigid base member.

4. A device as defined in claim 1 wherein the mounting points of the restraining assembly are attached to the long rigid base member in a staggered manner such that one attachment point is located closer to said one end of the long rigid base member than the other mounting point whereby the restraining band covers the foot at a natural angle.

5. A device as defined in claim 1 wherein the length of the restraining band between the two mounting points of the restraining assembly is adjustable, allowing the length of the band of the restraining assembly to be shortened or extended.

* * * * *